US005386964A

United States Patent [19]

Mayo

[11] Patent Number: 5,386,964

[45] Date of Patent: Feb. 7, 1995

[54] DESK PAD COMPRISING A FIBROUS BACKING AND A SUBSTANTIALLY SMOOTH FACING

[75] Inventor: Steve Mayo, Bronx, N.Y.

[73] Assignee: Artistic Desk Pad & Novelty Co., Inc., Bronx, N.Y.

[21] Appl. No.: 9,625

[22] Filed: Jan. 27, 1993

[51] Int. Cl.[6] ..... A47B 91/00

[52] U.S. Cl. ..... 248/346; 428/68; 428/194; D19/99

[58] Field of Search ..... 248/346, 346.1; 182/230; D19/99; 281/3, 44, 45; 428/71, 68, 74, 76, 102, 192, 194, 318.4

[56] References Cited

U.S. PATENT DOCUMENTS

| | | | |
|---|---|---|---|
| 1,856,160 | 5/1932 | Gutberlet | 248/346 X |
| 2,004,166 | 6/1935 | Low | 248/346.1 |
| 2,061,664 | 11/1936 | Lincoln | 182/230 |
| 3,261,586 | 7/1966 | Bengtsson | 248/346 |
| 3,428,002 | 2/1969 | McIntire, Jr. et al. | 248/346 |
| 3,637,454 | 1/1972 | Pavernick | 248/346 X |
| 3,729,037 | 4/1973 | Dare et al. | 248/346.1 X |
| 3,744,435 | 7/1973 | Tracy et al. | 211/69.7 |
| 4,405,673 | 8/1983 | Fridley et al. | 248/346 X |
| 4,789,046 | 12/1988 | McDowall | 248/346 X |
| 4,801,483 | 1/1989 | Beckerman et al. | 428/71 |
| 4,876,135 | 10/1989 | McIntosh | 428/76 X |
| 5,000,413 | 3/1991 | Kawashima | 248/346.1 |
| 5,018,695 | 5/1991 | Bishop | 248/346.1 |
| 5,021,277 | 6/1991 | Fan | 428/76 |
| 5,022,170 | 6/1991 | House | 281/45 |
| 5,152,018 | 10/1992 | Lea | 428/71 X |

*Primary Examiner*—Ramon O. Ramirez
*Assistant Examiner*—Korie H. Chan
*Attorney, Agent, or Firm*—Sprung Horn Kramer & Woods

[57] ABSTRACT

A desk pad comprising a fibrous backing and a substantially smooth facing, the backing and facing being bonded to one another peripherally and also at some short distance inwardly from the peripheral bond, thereby to form a central zone having a pocket and a peripheral zone having a pocket, a central filler within said central pocket and comprising a compressible base and a relatively rigid topping, and a peripheral filler in said peripheral pocket and comprising a relatively rigid base and a compressible topping, whereby the peripheral zone constitutes a soft support for a writer's arm while the central zone constitutes a firm writing support, is produced by laying down said backing, superposing on said backing said peripheral filler and spaced therein said central filler, positioning thereon said facing, and applying heat and pressure to fuse said facing to said backing to form said peripheral bond and inner bond and said peripheral and central pockets.

3 Claims, 2 Drawing Sheets

DESK PAD COMPRISING A FIBROUS BACKING AND A SUBSTANTIALLY SMOOTH FACING

BACKGROUND OF THE INVENTION

This invention relates to a novel desk pad which is comfortable to write on, attractive and inexpensive to produce.

OBJECT OF THE INVENTION

Desk pads in their simplest form merely protect the desk surface they cover, so the points of pencils and pens do not mar the desk surface.

It is an object of the invention to provide a desk pad which has positive attributes, not merely protective attributes.

It is a further object of the invention to provide a pad which provides support for the writer's arm, which holds itself in position on the desk, which is attractive, and inexpensive to produce.

These and other objects are realized in accordance with the invention pursuant to which there is provided a desk pad comprising a fibrous backing and a substantially smooth facing, the backing and facing being bonded to one another peripherally and also at some short distance inwardly from the peripheral bond, thereby to form a central zone having a pocket and a peripheral zone having a pocket, a central filler within said central pocket and comprising a compressible base and a relatively rigid topping, and a peripheral filler in said peripheral pocket and comprising a relatively rigid base and a compressible topping, whereby the peripheral zone constitutes a soft support for a writer's arm while the central zone constitutes a firm writing support.

Advantageously the peripheral zone on top of its pocket includes two layers, one layer being of the same material as the top of the central zone, that layer being below the other layer and being integral with the layer of said peripheral zone which is of the same material.

Desirably the facing comprises a thin sheet of thermoplastic polymer, e.g. about 0.1 to 1 mm of a polyvinyl sheet. The backing comprises a comparable or even thinner sheet carrying a very thin foam or fibrous backing, also desirably thermoplastic. The second, preferably upper, layer of the peripheral zone is of generally similar composition to the smooth facing, although it may be grained to impart a less smooth surface.

The fillers are approximately one quarter inch thick, approximately half the thickness being relatively rigid material and approximately half being compressible, e.g. cardboard or fiber board, bonded to foam rubber.

The bonds, peripheral and spaced therefrom, are advantageously thermoplastic.

The invention also extends to a method of making such pad, comprising laying down said backing, superposing on said backing said peripheral filler and spaced therein said central filler, positioning thereon said facing, and applying heat and pressure to fuse said facing to said backing to form said peripheral bond and inner bond and said peripheral and central pockets. Advantageously, prior to bonding there is placed on said facing a peripheral second layer, the heat and pressure also serving to bond said peripheral second layer to said facing.

DETAILED DESCRIPTION OF THE DRAWINGS

Figure 1:
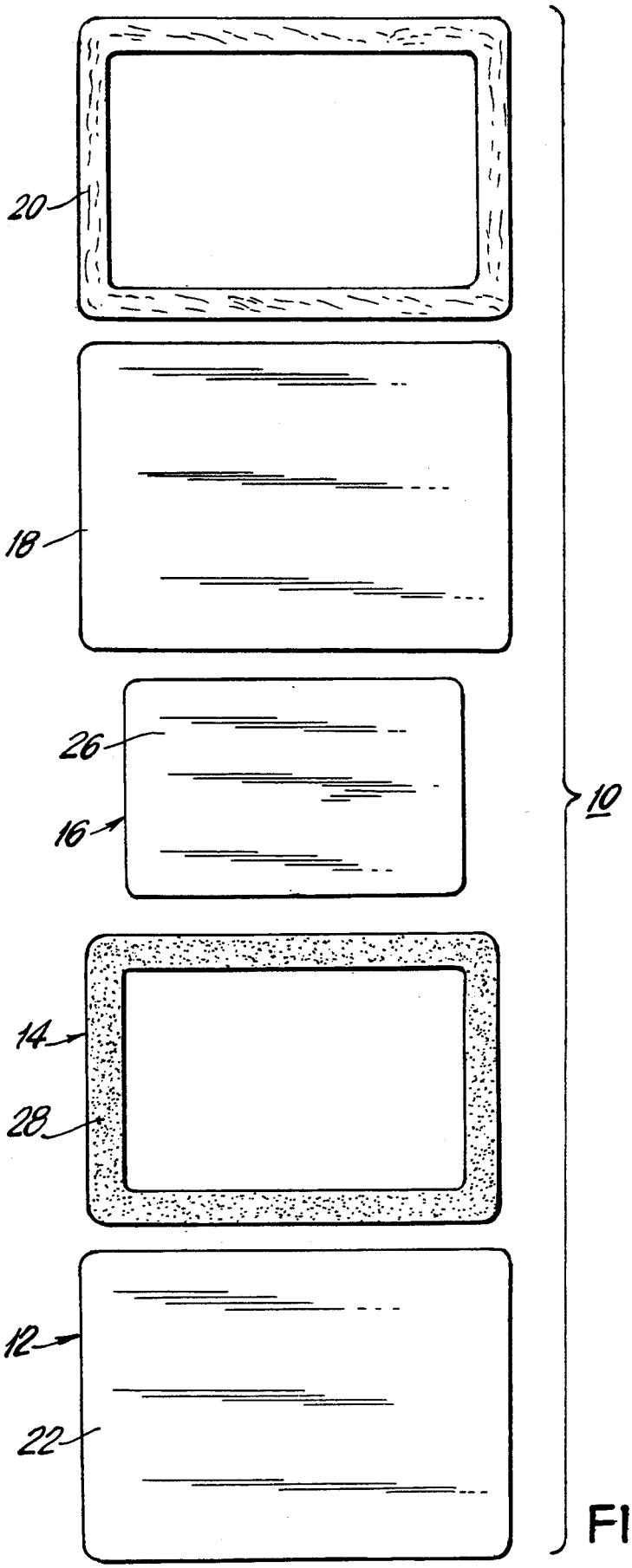
FIG. 1 is an exploded view of the elements making up the novel pad prior to assembly.
Figure 2:
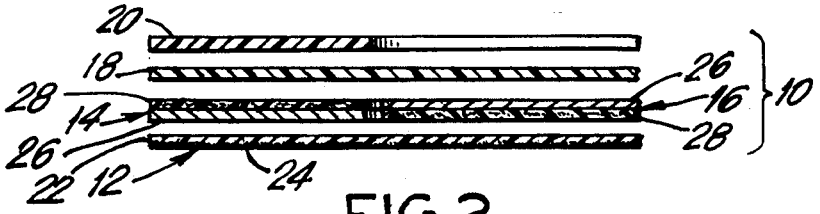
FIG. 2 is a sectional view of the assembled elements prior to bonding.

The invention will be first described with reference to the method of making the novel pad, as shown in FIGS. 1 and 2, i.e. showing the several individual layers making up the desk pad 10 prior to assembly. There is shown a backing layer 12, a peripheral filler layer 14, a central filler layer 16 slightly smaller in perimeter than the window of layer 14, a facing layer 18 and a second peripheral facing layer 20. The layers are superposed with filler layer 16 inside the window of filler layer 14, heat and pressure are applied to effect bonding and, after cooling, if necessary the periphery is trimmed away.

In making the structure those layers which must bond are made of thermoplastic materials such as homopolymers or copolymers of vinyl chlorides, fluorides or the like.

Suitable pins and/or alignment holes may be provided properly to position the several layers relative to one another during assembly.

Figure 3:
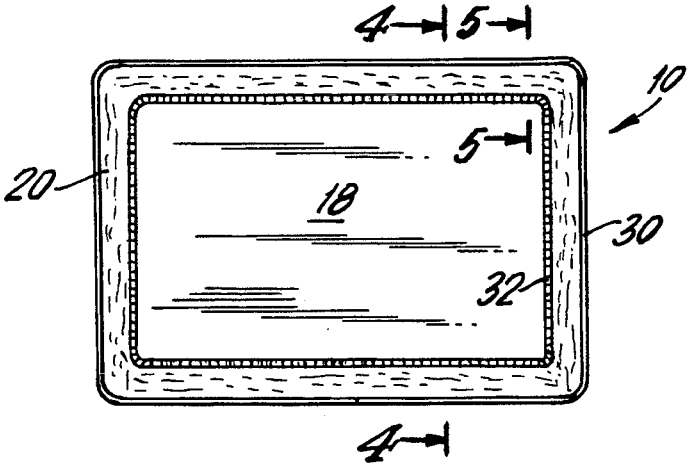
FIG. 3 is a top plan view of the bonded pad in accordance with the invention.
Figure 4:
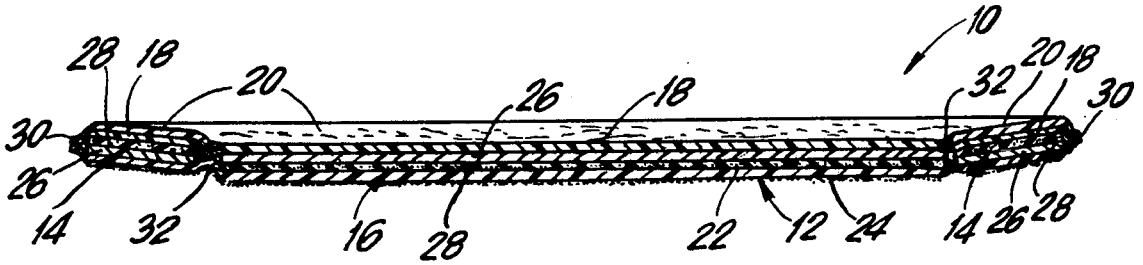
FIG. 4 is a sectional view on line 4—4 of FIG. 3.
Figure 5:
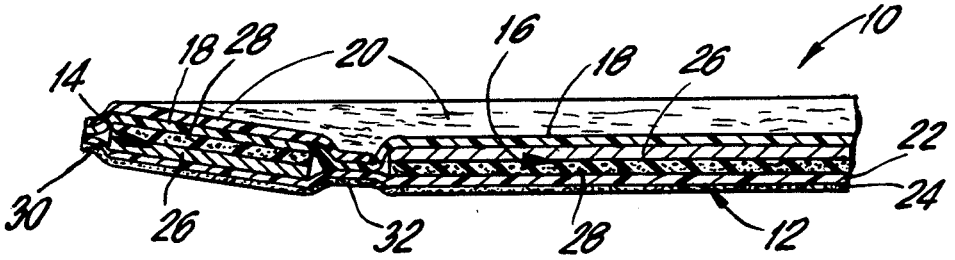
FIG. 5 is an enlarged sectional view on line 5—5 of FIG. 3.

The resulting structure is as shown in FIGS. 3, 4 and 5, which also better show the make-up of the individual elements.

The backing layer 12 has a thermoplastic facing 22 and a backing 24 which is fibrous or foam-like; that backing will contact the desk in use.

The peripheral filer layer 14 and central filler layer 16 are desirably of similar and preferably identical make-up, but reversed. They comprise a rigidified cardboard layer 26 to which there is adhered a thin foam layer 28. Advantageously each of the layers 26 and 28 is of approximately one eighth inch thickness. For peripheral filler layer 14 the foam layer 28 is on top; for central filler layer 16 the foam layer 28 is on the bottom.

The facing layer 18 is peripherally bonded to the backing layer 12 at 30 and is also bonded thereto at 32, i.e. the space between filler layers 14 and 16. Thus there is defined a peripheral pocket in which 14 is located and a central pocket in which 16 is located.

Peripheral facing layer 20 forms a top-most frame, being bonded to facing layer 18 at the same locations that 18 is bonded to 12. Its composition, texture and/or appearance may differ from 18, if desired, to improve its performance.

Thus, in the completed structure there is a firm central top, just below facing 18, having a softer bottom to conform to the desk surface on which the pad rests.

Surrounding such center is a frame which actually tends to bend up at a slight angle. That frame has a firm backing but a soft top (due to foam layer 28) which forms a comfortable cushion for the user's arm.

It will be appreciated that the instant specification and claims are set forth by way of illustration and not limitation, and that various modifications and changes may be made without departing from the spirit and scope of the present invention.

What is claimed is:

1. A desk pad for use on a writing surface comprising;

a fibrous backing layer, a substantially smooth facing layer, the backing layer and facing layer being bonded to one another peripherally and bonded at a distance inwardly from the peripheral bond to form a bond ring which is concentric to said peripheral bond to thereby form a central zone having a central pocket and a peripheral zone having a peripheral pocket;

a central filler disposed within and substantially filling said central pocket which comprises a relatively rigid top layer positioned below said smooth facing layer and a compressible base layer positioned below said rigid top layer;

a peripheral filler disposed within and substantially filling said peripheral pocket which comprises a compressible top layer positioned below said smooth facing layer, and a relatively rigid base layer positioned below said compressible top layer;

wherein the rigid top layer of said central zone is of the same material as the rigid base layer of said peripheral zone, and the compressible base layer of the central zone is of the same material as the compressible top layer of the peripheral zone such that the peripheral zone provides a soft support for a writer's arm while the central zone provides a firm writing support.

2. Said pad according to claim 1, wherein the bonds are thermoplastic bonds.

3. Said pad according to claim 1, wherein the fillers are approximately one quarter inch thick, approximately half the thickness being relatively rigid material and approximately half being compressible.

* * * * *